United States Patent [19]

Blom et al.

[11] 4,192,230

[45] Mar. 11, 1980

[54] PRINTER, PROVIDED WITH AN IMPACT DEVICE COMPRISING A TRANSDUCER

[75] Inventors: Nico Blom; Jan T. Wor, both of Rijswijk, Netherlands

[73] Assignee: U.S. Philips Corporation, New York, N.Y.

[21] Appl. No.: 872,169

[22] Filed: Jan. 25, 1978

[30] Foreign Application Priority Data

Nov. 3, 1977 [NL] Netherlands ..... 7712160

[51] Int. Cl.[2] ..... B41J 7/92

[52] U.S. Cl. ..... 101/93.03; 400/144.2; 101/93.29; 400/124; 400/157.3

[58] Field of Search ..... 101/93.03, 93.29–93.34, 101/93.48; 400/144.2, 144.3, 144.4, 124, 157.3; 361/154, DIG. 4

[56] References Cited

U.S. PATENT DOCUMENTS

| | | | |
|---|---|---|---|
| 3,909,681 | 9/1975 | Campari et al. | 361/154 |
| 3,919,934 | 11/1975 | Beery | 101/93.29 |
| 4,027,761 | 6/1977 | Quaif | 101/93.03 X |
| 4,062,285 | 12/1977 | Deetz et al. | 101/93.03 X |
| 4,147,438 | 4/1979 | Sandrone et al. | 400/144.2 |

FOREIGN PATENT DOCUMENTS

| | | | |
|---|---|---|---|
| 2402895 | 7/1975 | Fed. Rep. of Germany | 101/93.29 |
| 2717975 | 11/1977 | Fed. Rep. of Germany | 400/144.2 |
| 1436992 | 5/1976 | United Kingdom | 101/93.03 |

OTHER PUBLICATIONS

Mills et al., IBM Technical Discl. Bulletin, vol. 15, No. 8, Jan. 1973, p. 2365.

*Primary Examiner*—Edward M. Coven
*Attorney, Agent, or Firm*—Thomas A. Briody; William J. Streeter; Bernard Franzblau

[57] ABSTRACT

A printer comprising an impact device which is provided with an impact member which is electromechanically driven and whose position or speed is measured by means of a transducer in order to obtain a speed signal which is compared with a reference signal in a comparator. The signal output of the comparator is connected to a signal input of an electrical actuation device for driving the impact member, the actuation of the drive being terminated only after a stop signal has appeared on the signal output of the comparator. An adapted speed of the impact member is obtained in all circumstances in a printer in accordance with the invention.

20 Claims, 9 Drawing Figures

PRINTER, PROVIDED WITH AN IMPACT DEVICE COMPRISING A TRANSDUCER

Figure 1:
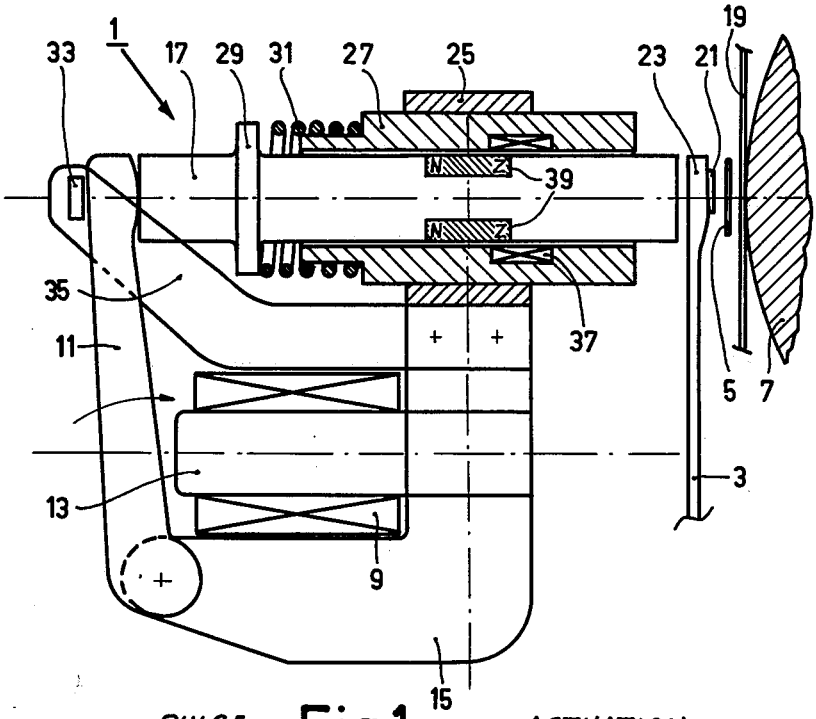

The invention relates to a printer provided with an impact device comprising an impact member which can be displaced from a rest position in the direction of a record carrier by means of an electro-mechanical drive. In a known printer of the kind described (U.S. Pat. No. 4,062,285 assigned to Xerox Corporation), the magnitude of the excitation (actuation) current pulse, after having reached a maximum value, is gradually reduced to a preset value (adjusted prior to the start of printing) in order to ensure a suitable impact force for each letter type. The excitation or actuation current pulse for a given letter type remains substantially the same during printing as far as waveform, magnitude and duration are concerned, and can be changed only after printing.

A drawback of the known printer consists in that, should the circumstances change during printing, automatic adaptation of the actuation current pulse is not possible so that, for example, static frictional forces on the impact member, which change as the operating temperature changes, cannot be compensated for.

Another embodiment of a printer is described in I.B.M. Technical Disclosure Bulletin, Vol. 15, No. 8, January 1973, page 2356. This printer also includes an impact device comprising an impact member which can be displaced from rest position in the direction of a record carrier by means of an electro-mechanical drive. The printer further comprises an impact device including a transducer which supplies, during the displacement of the impact member, a signal from which the speed of the impact member can be derived. A signal output of said transducer is connected to a first signal input of a comparator which has a second signal input which is connected to a reference signal device and a signal output which is connected to first signal input of an electrical actuation device for said electro-mechanical drive of the impact member. Actuation of said electro-mechanical drive commences after reception of a start signal on a second signal input and an actuation current is interrupted only after the appearance of a stop signal on the signal output of the comparator. The technique described ensures that the impact member always has a preadjusted and desired speed at the instant at which it strikes a record carrier.

In a printer it is important to obtain a regular printing pattern which is achieved only if the impact member strikes at the correct instant. In said known printer, however, the impact member can strike at the correct instant only if the impact member is stationary in the correct starting position (neutral position) when the actuation commences. Therefore the speed of the aforesaid printer is limited by the time required by the impact member after an impact to reach standstill in its starting position.

One object of the present invention is to provide a printer in which the impact force of the impact member remains constant to a comparatively high degree as a result of automatic adaptation of the excitation current pulse in the event of changing circumstances. Another object of the invention is to provide a printer which eliminates the aforesaid limitation on the printing speed. To this end, a printer in accordance with the invention includes an impact device comprising a transducer which, during the displacement of the impact member, supplies a signal wherefrom the speed of the impact member can be derived. A signal output of said transducer is connected to a first signal input of a comparator which has a second signal input which is connected to a reference signal device and which also has a signal output which is connected to a signal input of an electrical actuation device for said electro-mechanical drive of the impact member. The actuation of the drive is terminated only after the appearance of a stop signal on the signal output of the comparator. The printer further comprises calculating means coupled to the transducer output for deriving a control signal that is dependent on the speed and position of the impact member. An output terminal of the calculating means is connected to a control input of the actuation device. Because at any given instant during printing the speed of the impact member of a printer in accordance with the invention is compared with a speed reference value which ensures a given impact force, and because the actuation is terminated only when the actual speed equals the speed reference value, a changing frictional force (for example, due to a change in temperature and/or wear) has only a negligible effect on the impact force. A very special embodiment of a printer in accordance with the invention is characterized in that the actuation device comprises a pulse generator which supplies pulses having a duration which is smaller than and a repetition time which is larger than the time required by the impact member to perform its maximum displacement from the rest position in the direction of the record carrier due to such a pulse. A pulse generated by the pulse generator is terminated only after a stop signal has appeared on the signal output of the comparator.

In a printer in accordance with the invention, comprising a pulse generator and calculating means, the printing speed is in principle rendered independent of the time which would be required by the impact member to reach standstill in the neutral position after impact with the record carrier. Because the speed and the position of the impact member are known at any instant during the movement, an actuation pulse for renewed printing, following a first actuation current pulse, can be given during the entire period of time expiring between a first impact with the record carrier and the subsequent standstill of the impact member. Therefore, it is no longer necessary for the impact member to reach standstill in its neutral position before a so-called subsequent pulse for renewed driving of the impact member is supplied. This subsequent pulse can now already be permitted while the impact member is still in motion. The required magnitude and duration of the subsequent actuation pulse can be calculated from the known position and speed of the impact member so that, in the case of repeated printing, the speed of the impact member just before the instant of impact with the record carrier is substantially equal to the speed of the impact member just before impact in the case of a first impact. Even the direction in which the impact member moves after a first impact with the record carrier does not impose a restriction as regards the instant at which the subsequent pulse may be permitted. Thus, the subsequent pulse can be supplied, for example, when the impact member, after impact with the record carrier, has already rebounded from an abutment and has again obtained a forward movement ("forward" is to be understood to mean herein towards the record carrier). The polarity of the subsequent pulse may be the same for a forward as well as a return movement. In the case of a return movement of the impact member, the speed of the impact member is first reduced, and subsequently its direction is reversed and the speed is increased again. In the case of a forward movement of the impact member, only the speed is increased. In this respect it is to be noted that in the printer which is known from U.S. Pat. No. 4,062,285, the actuation is maintained for some time (braking action) after the impact member strikes the record carrier so that the risk of rebounding of the impact member is reduced.

Figure 2:
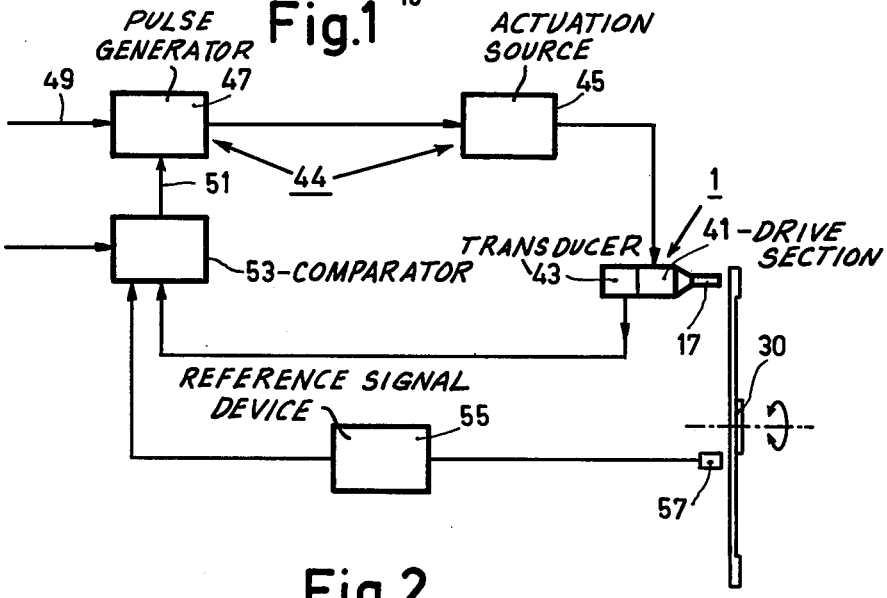
Figure 3:
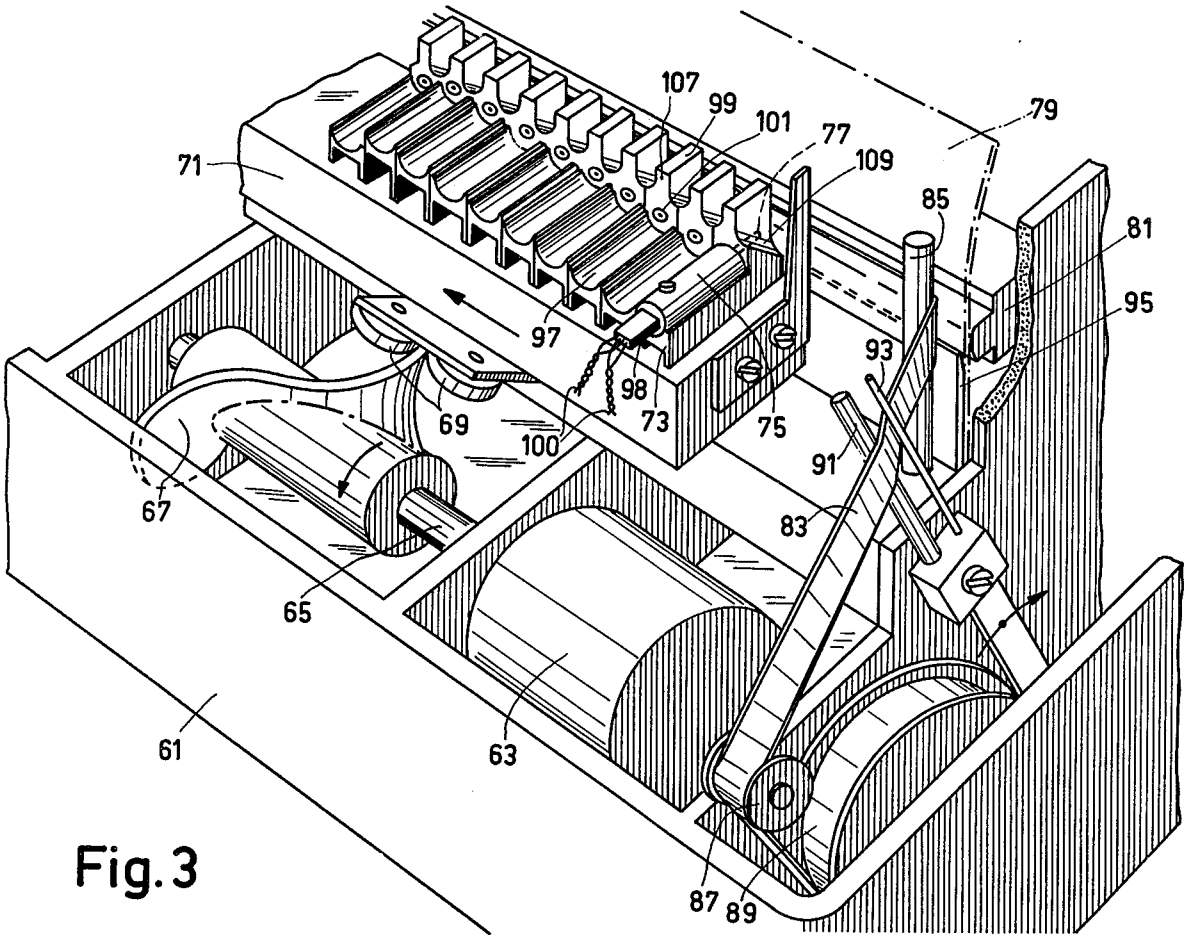
Figure 4:
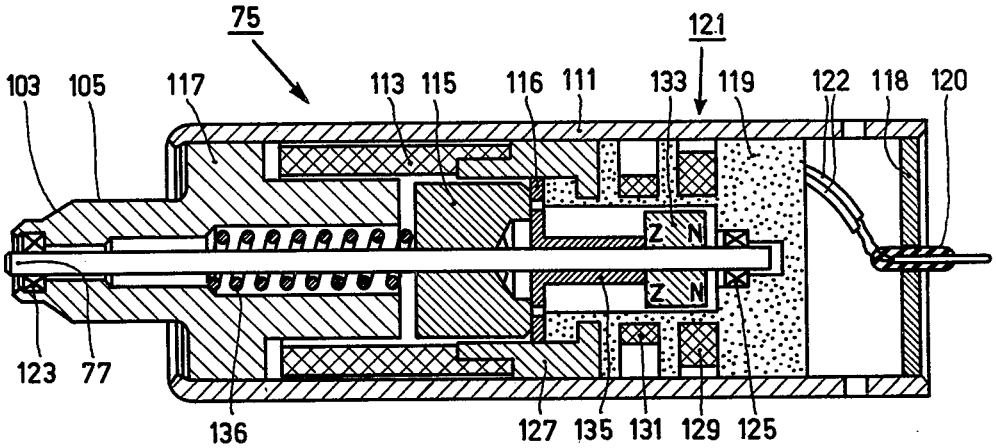
Figure 5:
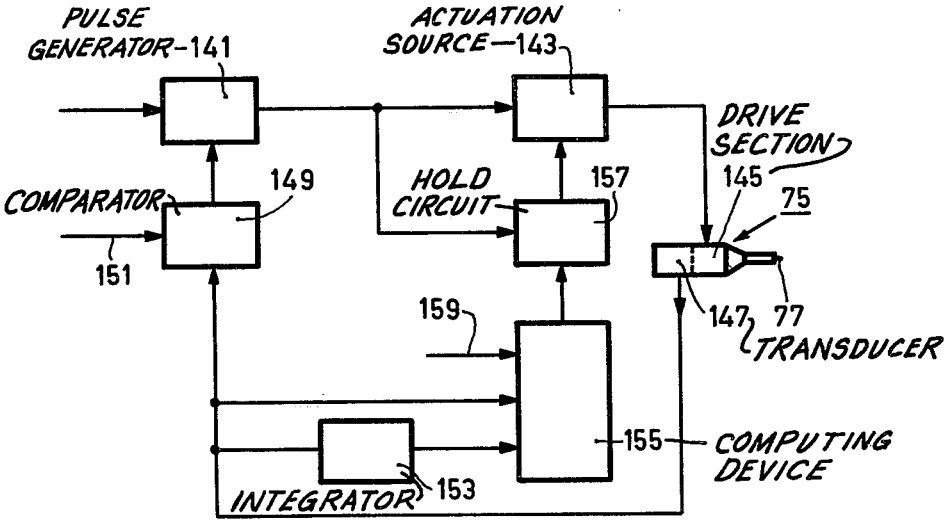
Figure 6:
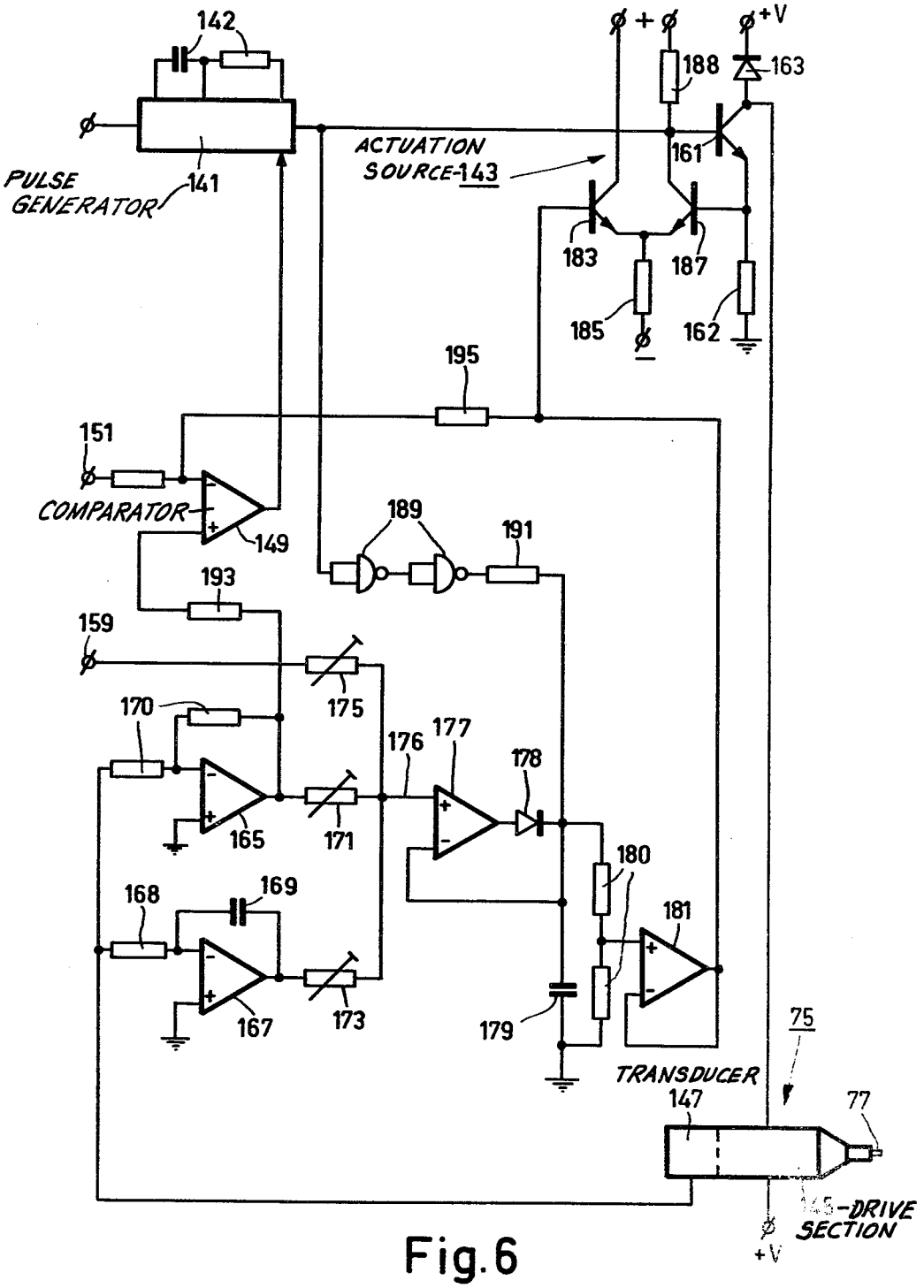
Figure 7:
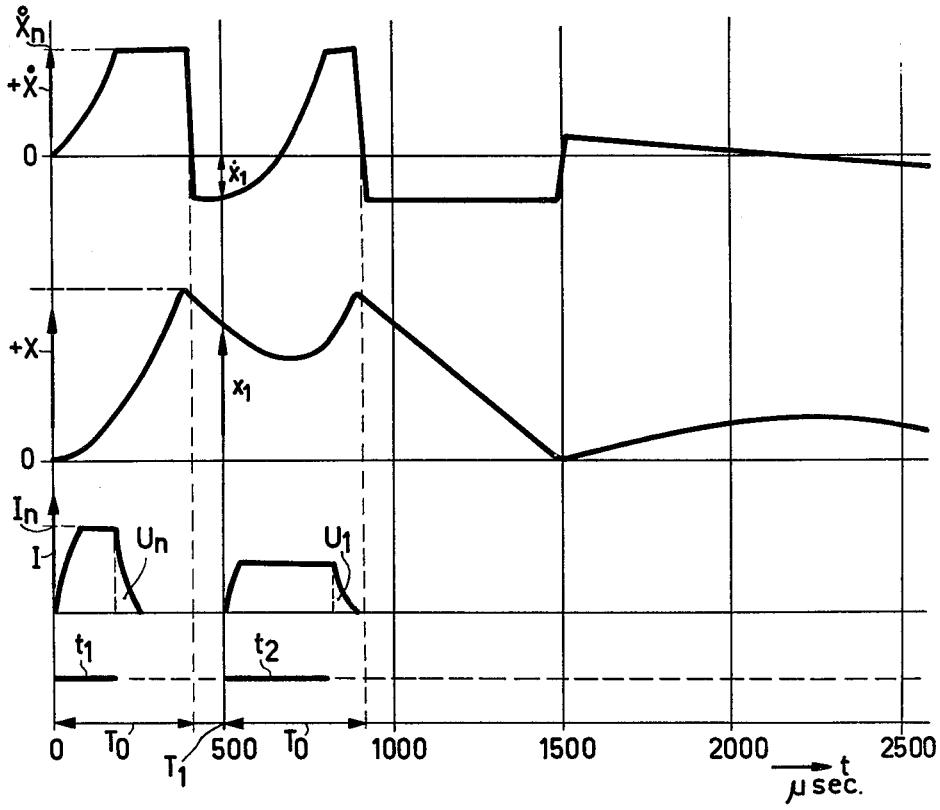

The invention will be described in detail hereinafter with reference to the accompanying drawing, in which:

FIG. 1 is a simplified view of an electromechanical impact device of a typewheel printer in accordance with the invention, FIG. 2 is a block diagram of an electrical circuit arrangement for controlling the impact device of FIG. 1, FIG. 3 is a perspective view of a part of a matrix printer in accordance with the invention, FIG. 4 is a sectional view of an impact device for a printer as shown in FIG. 3, FIG. 5 shows a block diagram of an electrical circuit arrangement in accordance with the invention for controlling the impact device shown in FIG. 4, FIG. 6 shows a preferred embodiment of an electrical circuit arrangement according to the block diagram shown in FIG. 5, FIG. 7 shows a speed, position and actuation diagram of a recording pin of the impact device shown in FIG. 4.

Figure 8:
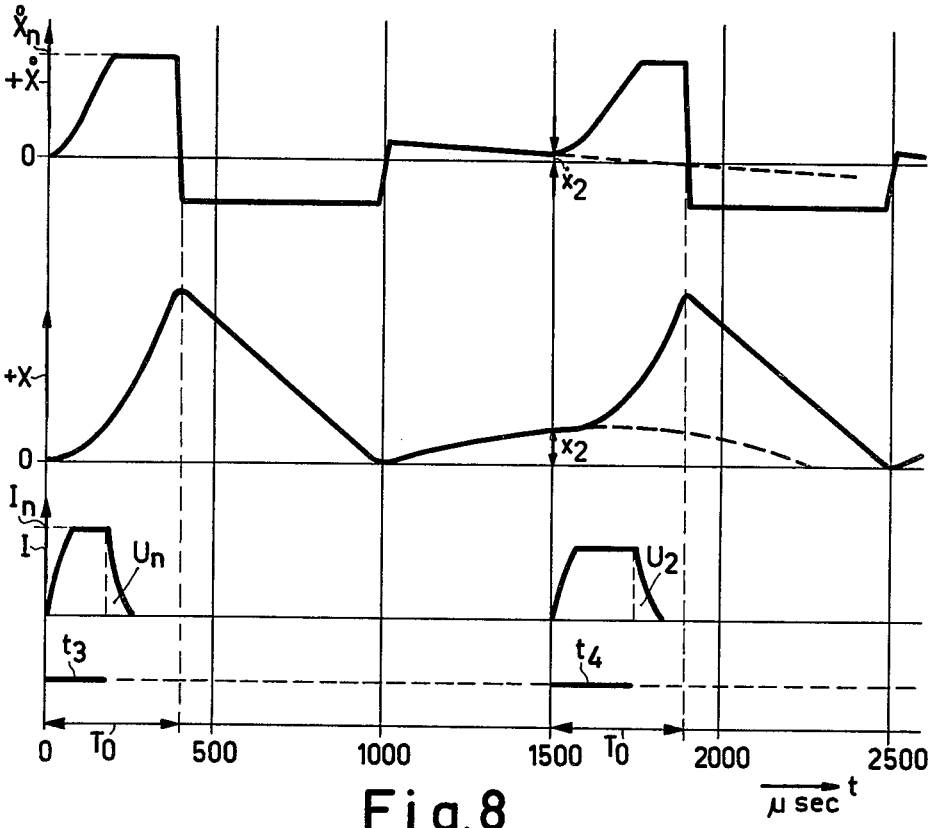
Figure 9:
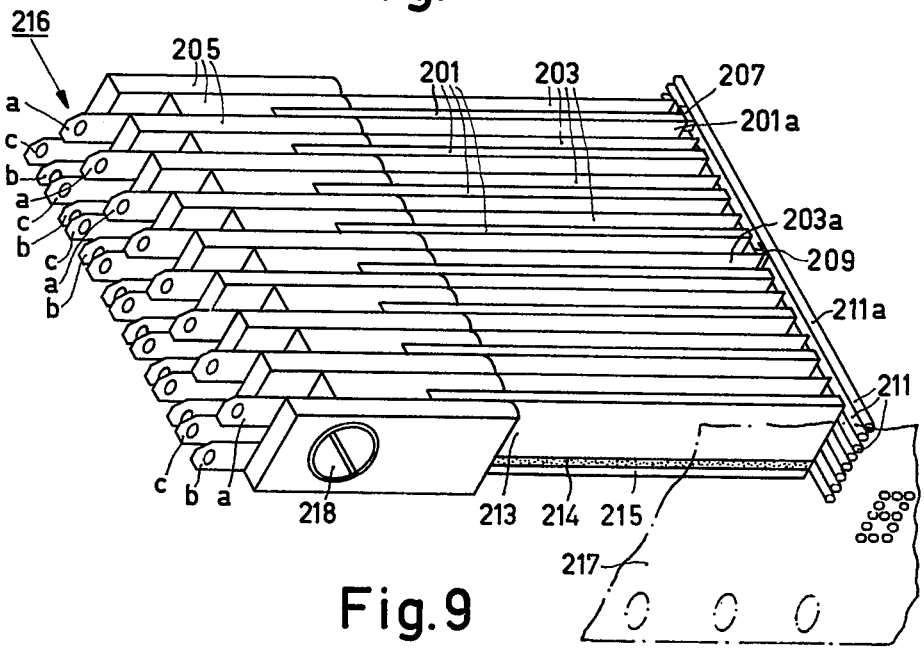

FIG. 8 shows further diagrams of the recording pin in changed circumstances, and FIG. 9 is a perspective view of a further impact device in accordance with the invention.

FIG. 1 shows a typewheel printer in accordance with the invention. For the sake of simplicity, only an impact device 1, a flexible spoke 3, an ink ribbon 5 and an anvil 7 thereof are shown. The typewheel printer shown in FIG. 1 is of a type as described, for example, in U.S. Pat. Nos. 3,707,214 and 3,954,163, comprising a typewheel which is intermittently rotatable on a displaceable carriage. When an excitation coil 9 of the impact device 1 is excited, a pivotable arm 11 is attracted against a coil core 13 in order to form, in conjunction with a yoke 15, a magnetic circuit having a magnetic resistance which is as low as possible. A plunger 17 (impact member) of magnetically nonconductive or poorly conductive material is forced against the spoke 3 by the pivotable arm 11 so that the spoke 3 deflects and strikes, together with the ink ribbon 5, a record carrier 19, for example, a sheet of paper, which is arranged in front of the anvil 7. On the sheet of paper an image of a character 21 is obtained, said character being provided in relief on an end 23 of the spoke 3.

An end 25 of the yoke 15 grips around a tube 27 in which the plunger 17 is journalled so as to be slidable. The plunger 17 comprises a shoulder 29. One end of a helical spring 31 bears against this shoulder and its other end bears against the tube 27. The helical spring 31 serves to return the plunger 17 to the rest position (neutral position). This rest position is defined by an abutment 33 on a supporting arm 35 connected to the yoke 15. After termination of an excitation of the coil 9, the helical spring 31 forces the plunger 17 back until it is lightly biased against the pivotable arm 11 which in its turn bears against the abutment 33.

The impact device 1 comprises a speed transducer which includes a measuring coil 37, secured in the tube 27, and a tube-shaped permanent magnet 39 which is glued in a recess in the plunger 17. During the movement of the magnet 39, a voltage is induced in the measuring coil 37 by a variation of the magnetic flux enveloped by the coil, the value of said voltage being a measure of the instantaneous speed of the plunger 17.

The impact device shown in FIG. 1 is controlled by an electrical circuit arrangement whose block diagram is shown in FIG. 2. The impact device 1 comprises a drive section 41 (drive) and a transducer section 43. The drive section 41 is driven by an actuation device 44 and comprises an excitation coil 9, a coil core 13 and a yoke 15. The actuation device 44 comprises an actuation source 45 and a monostable multivibrator 47(pulse generator), referred to hereinafter as MMV47. The duration $\tau$ of the pulse generated by the MMV47 at least equals the period of time expiring between the beginning of the excitation of the coil 9 and the instant at which the plunger 17 strikes the spoke 3. The MMV47 controls the actuation source 45 and comprises a trigger input 49 and a reset input 51. The transducer section 43 of the impact device 1 is connected to a first input of a comparator 53, a second input of which receives a reference signal. The reference signal is generated by a reference signal device 55.

When a pulse originating from a customary control logic device is applied to the trigger input 49, the MMV47 changes over from its stable to its unstable state. The actuation current source 45 is then switched on and actuates the drive section 41 of the impact device 1. As a result, the plunger 17 leaves its rest position and moves in the direction of the typewheel 30. The instantaneous speed of the plunger 17 is measured by the transducer section 43. The speed signal generated by the transducer section is compared by the comparator 53 with the reference signal generated by the reference signal device. As soon as the speed signal becomes equal to or larger than the reference signal, the comparator 53 generates a stop signal which returns the MMV47 to its stable state via the reset input 51 of the MMV47. The actuation source 45 is switched off so that the plunger 17 is not further accelerated. The plunger 17 has then reached the speed determined by the reference signal.

The described impact device and electrical circuit arrangement enable adaptation of the impact force with which the plunger 17 strikes the anvil 7 (see FIG. 1) to the surface of the character for the various characters to be printed. This is notably important for obtaining a regular print of the various characters.

In order to generate a reference signal which is a measure for the surface of the character to be printed, the position of the typewheel 30 is determined by means of a customary device which comprises a pulse generator 57, for example, light-sensitive semiconductor diodes which co-operate with a light source and which supply pulses for each spoke of the typewheel 30 which passes the diodes. The reference device 55 may be, for example, a shift register which shifts to the left or to the right and which has an output that adjusts a reference signal via a decoding device (for example, a diode matrix).

The major advantage of the circuit shown in FIG. 2 consists in that the actual speed of the plunger 17 is compared with the reference signal and in that the actuation of the drive section 41 of the impact device is stopped only after the desired speed has been reached. This has a useful effect in that automatic, necessary adaptation of the actuation is obtained should static frictional forces on the plunger change in given circumstances, for example, due to a change in operating temperature.

The special embodiment of a matrix printer in accordance with the invention (of the kind described in U.S. Pat. No. 3,967,714) which is shown in FIG. 3 comprises an electric motor 63 which is arranged in a housing 61 and whose drive shaft 65 is coupled to a helical drive cam 67. By means of two rolls 69, guided on the flanks of the cam 67 and rotatably connected to a bar 71, a continuous, reciprocating horizontal translatory movement of the bar 71 is obtained (on-the-fly printing). A number of supports 73 of identical shape are mounted on the bar 71, an impact device 75 being secured in each of said supports. FIG. 3 shows only one of these impact devices 75. Each of the impact devices 75 comprises (see FIG. 4) at least one holder, an exciter coil, a measuring coil system, and a recording pin (impact member) which is oriented so that it extends parallel to the recording pins of the impact devices 75 in the other supports 73. The recording pins 77 are displaceable in a direction perpendicular to a record carrier 79 which is situated behind the supports 73. The speed of the recording pin 77 is measured by the measuring coil system. A displaceable anvil 81 (not visible in the Figure) is arranged behind the record carrier 79. Between the record carrier 79 and the ends of the recording pins 77 which face the record carrier, an ink ribbon 83 is present at the instant of printing, the ribbon being guided along a rear face of the supports 73 at the level of the recording pins 77. The ink ribbon 83 is further guided on both sides of the printer (only the right-hand side is visible) around a fixed pin 85, via a guide roller 87, to a reel 89. On the traject between the pin 85 and the guide roller 87, the ink ribbon 83 is guided between two pins 91 and 93 which can be rotated together in a plane perpendicular to the movement direction of the bar 71. Between the record carrier 79 and the ink ribbon 83 is a rigidly arranged plate 95 whose upper side is bevelled and which prevents the record carrier and the ink ribbon from contacting each other before the instant of printing. This would cause ink smears on the record carrier, which is to be referred to hereinafter as the paper. The plate 95 also serves as an abutment for the anvil 81. After each line printed, the anvil 81 is briefly pulled backwards in order to enable paper transport. The paper transport means are of a customary type so they are not shown herein for the sake of clarity. The paper 79 is intermittently transported in a direction transverse to the movement direction of the bar 71. The ink ribbon 83 is in the position shown at the instant of printing. Obviously, part of the width of the ink ribbon 83 is then situated above the plate 95. The recording pins 77 are in a position just above the upper side of the plate 95.

The bar 71 of the printer shown in FIG. 3 accommodates six series of nine individual supports 73 each. The centre-to-centre distances of the recording pins 77 in each series are equal. A support 73 essentially is shaped like a chair comprising a cradle-like portion (seat) or cradle 97 which is adjoined by a back-shaped portion or back 99. The cradle 97 has a cyclindrical shape which is slightly recessed, with the result that the circle-cylindrical circumference of the impact device 75, bearing in the cradle, has two line segments, parallel to each other and to the recording pin 77, in common with the cradle. The back 99 comprises a bore 101 which is circle-cylindrical on its side which is remote from the paper 79 and which is conically tapered on the other side. The centre line of the bore 101 coincides with the centre line of the recording pin 77. The impact device 75, which is shown in detail in FIG. 4, comprises a conical portion 103 and a circle-cylindrical portion 105. The conical portion 103 bears in the conical portion of the bore 101, whereas the circle-cylindrical portion 105 bears in the circle-cylindrical portion of the bore 101.

In the embodiment of a printer in accordance with the invention as shown in FIG. 3, the back 99 of each support 73 comprises a narrowed portion 107. The back 99, moreover, comprises a bevelled portion on either side which is directed towards the relevant recording pin, said bevelled portion adjoining the bevelled portion of an adjacent support. The narrowed portion 107 enables, in conjunction with the bevelled portions 109, the operator of the printer to observe the printing process. The frequency of the reciprocating bar is so high that a clear view is obtained of each character, substantially immediately after it has been printed. This is of major importance for error detection and enables quick intervention and stopping of the printer.

The impact device 75 is secured on the support 73 by means of a bolt. A plug 98 with connection wires 100 for the excitation coil and the measuring coil system is secured on the end of the impact device 75 which is remote from the recording pin.

FIG. 4 is a sectional view at an increased scale of an impact device 75 for a printer as shown in FIG. 3. The impact device 75 comprises a holder 111, an excitation coil 113, and a recording pin 77 on which a core 115 is mounted, and also a pin holder 117, a coil holder 119, and a measuring coil system 121. The pin 77 is journalled in sleeve bearings 123 and 125 near both ends. When the coil 113 is excited, the core 115 is attracted, together with the pin 77, towards the pin holder 117. The core 115 forms, in conjunction with the holder 111, the pin holder 117 and the coil support 127, a circuit having a low magnetic resistance. The coil support 127 supports the excitation coil 113 and is connected to the coil holder 119. The coil holder 119 supports the measuring coil system. The measuring coil system comprises a series connection of a measuring coil 129 and a compensation coil 131 which co-operate with an annular, axially polarized (magnetic poles denoted by the references N and Z) permanent magnet 133. The permanent magnet 133 is rigidly connected to the recording pin 77. A spacing bush 135 is arranged on the pin 77 in order to enable accurate positioning of the magnet 133 with respect to the measuring coil system 121. In the rest position, the core 115 is biased against an annular abutment 116 under a given force which is obtained by means of a helical spring 136 which serves as a return spring.

The holder 111 is closed at the rear by means of a lid 118 in which four plug pins 120 are provided (only one plug pin is shown). The excitation coil 113 and the series connection of a measuring coil and compensation coil are connected to the plug pins 120 by way of connection wires 122.

When the coil 113 is excited, the core 115 and the permanent magnet 133 are attracted towards the pin holder 117 so that the varying flux enveloped by the measuring coil 129 and the compensation coil 131 induces a voltage which is a measure of the instantaneous speed of the magnet 133 and hence of the pin 77 at any given instant. However, the excitation of the coil 113 also generates mutually different interference voltages in the measuring coil and the compensation coil. This would cause an error in the measurment of the speed of the pin 77 if no further steps were taken. When the ratio of the number of turns of the measuring coil and the compensation coil is suitably chosen, the absolute values of the voltages induced in the measuring coil and the compensation coil due to the changing magnetic flux of the excitation coil are equal. Moreover, the compensation coil has a winding direction which opposes the winding direction of the measuring coil, so that the voltages produced by the stray field in the series connection of the measuring coil and compensation coil cancel each other.

In order to obtain a measuring signal which is proportional to the speed of the pin 77, the length of the magnet 133 is chosen to be approximately equal to the distance between the centres of the measuring coil and the compensation coil, the centre of the magnet being situated substantially in the centre of the measuring coil system 121. As a result, the variation of the flux enveloped is of opposite sign in the measuring coil with respect to the variation of the flux enveloped in the compensation coil. As a result of the opposite winding direction of the compensation coil, the voltages generated in the measuring coil and the compensation coil are summed.

When the measuring coil is suitably magnetically screened with respect to the excitation coil, no compensation coil is required, as in the impact device 1 shown in FIG. 1.

The block diagram shown in FIG. 5 for controlling the speed of the recording pin 77 of the impact device 75 comprises a monostable multivibrator 141 (pulse generator), referred to hereinafter as MMV141, and a controllable actuation current source 143 for driving the impact device 75, the latter including a drive section 145 (drive) and a transducer section 147. The drive section 145 inter alia comprises the excitation coil 113, and the transducer section 147 comprises the measuring coil system 121 (FIG. 4). The speed signal determined by the transducer section 147 is applied to a comparator 149, a second input 151 of which receives a reference signal. The output of the comparator 149 is connected to a reset input of the MMV141. After a start pulse has been applied to the MMV141, the actuation current source 143 is activated so that the drive section 145 is actuated. The time constant $\tau$ of the MMV141 should at least be equal to the period of time expiring between the beginning of actuation and the instant of impact of the recording pin 77 on the paper 79 (see FIG. 3). The recording pin 77 is accelerated and the resultant speed of the pin 77 is measured by the transducer section 147. The speed signal thus generated is compared with the reference signal by the comparator 149. As soon as the speed signal becomes equal to or larger than the reference signal, the comparator supplies a stop signal to the reset input of the MMV141. The MMV141 then returns to its stable state and the actuation current source 143 is switched off. The latter occurs substantially always before expiration of the period $\tau$.

The block diagram shown in FIG. 5 includes a further control network which includes calculation means comprising an integrator 153, a computing circuit (device) 155 and a hold circuit 157. This addition enables the printing speed (the number of striking movements per unit of time) of the recording pin to be substantially increased, it being possible to actuate the pin, after a first actuation pulse (actuation of the drive section), by a subsequent pulse before the recording pin has returned to its rest position. In that case the pin still has a speed (movement energy) and the distance between the pin and the paper (FIG. 3) is smaller than in the neutral (rest) position of the pin. However, after actuation by a subsequent pulse, the pin should still strike the paper with substantially the same impact force as previously and the period of time expiring between the instant of actuation and the instant of impact of the pin on the paper should remain substantially constant.

It has been found that the measurement of the speed and control of the duration of the actuation of the impact device on the basis of this measurement does not always suffice, notably in the case of the so-called on-the-fly printing, to achieve suitably accurate mutual positioning of the pin imprints. A subsequent pulse which directly follows a first actuation pulse can be proportioned only if the speed as well as the position of the recording pin are known at least at the instant of subsequent actuation.

The circuit shown in FIG. 5, comprising the integrator 153, the computing circuit 155 and the hold-circuit 157, adapts the amplitude of the actuation current so that the desired speed is reached within the fixed period of time, the period of time expiring between the beginning of the actuation and the instant of impact of the pin on the paper being constant. The speed signal produced by the transducer section 147 is applied to the computing circuit 155 directly as well as via the integrator 153. Via a third input 159, the computing circuit 155 receives a nominal value which determines the amplitude of the actuation current when the recording pin is in the rest position. On the basis of the speed signal and the integrated signal thereof, referred to hereinafter as the position signal, the computing circuit 155 calculates an addition to the nominal value. The output signal of the computing circuit 155 is applied to the controllable actuation current source 143 via the hold circuit 157. The control pulse for activating the actuation source 143 is also applied to the hold circuit. For the entire duration of the actuation, the hold circuit blocks the output signal of the computing circuit and maintains the output signal of the computing circuit on the control input of the controllable actuation current source during the start of the actuation. Thus, an actuation control is realized which renders the actuation dependent on the position and the speed of the recording pin during the start of the actuation.

FIG. 6 shows a simplified electronic circuit whose function and operation have already been described with reference to FIG. 5. The circuit comprises an MMV141 including an R-C member which determines a maximum actuation duration should the comparator 149 fail to supply a stop signal in time. Overheating of the excitation coil in the drive section 145 is thus prevented. The output of the MMV141 is connected to a base of an output transistor 161 of the controllable actuation source 143. The controllable actuation source 143 further comprises a power supply source +V. The transistor 161, referred to hereinafter as TRS161, becomes conductive when the MMV141 is not in the stable state. A current I then flows from +V through the drive section 145, TRS161 and an emitter resistor 162.

At the instant directly following the return of the MMV141 to the stable state, the current I through the drive section 145 (excitation coil 113) will not readily assume the value "0."The energy determined by the current I and stored in the excitation coil 113, which seems to be superfluous after the switching off of the TRS161, will have to be dissipated. To this end, the collector circuit of the TRS161 includes a diode 163 which short-circuits the drive section 145. In the circuit shown in FIG. 6, the current I will reach the value "0" according to a more or less exponential curve. If the diode 163 were not included in the collector circuit of the TRS161, TRS161 would dissipate this energy in a very short period of time so that it could be destroyed.

If necessary, a zener diode or a voltage-dependent resistor may be connected in series with the diode 163 so that the necessary energy dissipation is realized in a more controlled manner.

The measuring signal produced by the transducer section 147 is applied to the integrator 153, via the connection 164, and to an inverting amplifier 165. The integrator 153 comprises an amplifier 167, an input resistor 168 and an integrator capacitor 169. The resistors 170 of the amplifier 165 are equal and fix the gain of the amplifier 165 at −1. Via variable resistors 171, 173 and 175, together constituting a computing circuit 155, the speed signal, the position signal and a signal having a nominal value are applied to the hold circuit 157 via the input 176.

The hold circuit 157 comprises an amplifier 177 which is fed back by way of a diode 178. Between the diode 178 and ground there is provided a capacitor 179 which is charged via the diode 178 so that the voltage across the capacitor 179 equals the input voltage on the input 176. The voltage across the capacitor 179 is applied to the controllable actuation current source 143 via a high-ohmic voltage divider 180 and an isolating amplifier 181. The amplifier 181 controls a transistor 183 of a transistor pair 183–187 having a common emitter resistor 185. The collector of the transistor 187 is connected to the base of the TRS161, the emitter of which is connected to the base of the transistor 187. When MMV141 is in the non-stable state, the voltage drop across the resistor 188 is sufficient to control the current through TRS161 on the basis of the signal applied to the transistor 183 via the amplifier 181.

When the MMV141 supplies the controllable actuation current source 143 with an acutation pulse, this pulse is also applied to the hold circuit 157, via an AND-gate 189 having an open collector output whereto a resistor 191 is connected, and via a resistor 191. It is thus ensured, in conjunction with the diode 178, that changes in speed and position of the recording pin during the actuated state of the drive section 145 do not influence the voltage across the capacitor 179 of the hold circuit 157.

The output of the amplifier 165 is furthermore connected, via a resistor 193, to an input of the comparator 149. A reference source is connected to the other input 151 of the comparator 149. The output of the comparator 149 is connected to the reset input of the MMV141. As soon as the speed signal becomes equal to or larger than the reference signal, the comparator 149 supplies a stop signal which returns the MMV141 to the stable state. The TRS161 is thus switched off.

After TRS161 is switched off the current I will not immediately assume the value "0," but will decrease in the described manner according to a more or less exponential curve. As a result, the core 115 and the pin 77 (see FIG. 4) are subject to a residual acceleration until the current I has reached the value "0," i.e. until the energy present in the excitation coil at the instant of termination of the actuation has been dissipated.

Therefore, the ultimate speed of the pin 77 is higher than at the instant of resetting of the MMV141 to its stable state.

Therefore, the ultimate speed would become higher than the desired speed determined by the reference signal.

The difference between the two speeds is not equally large because the magnitude of the residual acceleration is determined by the amplitude of the actuation current I. The amplitude of the current I is dependent on the instantaneous position and the speed of the recording pin at the instant of actuation, and thus differs for each subsequent actuation of the excitation coil. Therefore, if no further steps were taken, different speeds would occur for the same reference signal, said speeds resulting in different impact forces of the pins on the paper. The amplitude of the current I is determined by the output signal of the amplifier 181. The occurrence of the described, actually undesirable residual acceleration can be simply utilized. The output signal of the amplifier 181 is applied, via a resistor 195, to the reference input of the comparator 149. As a result, the actual reference signal applied to the input 151 is influenced by the desired amplitude of the current I, so that the MMV141 is reset to the stable state before the desired speed of the pin 77 has been reached. The residual acceleration, determined by the amplitude of the current I, is utilized to achieve the desired speed any way (after the switching off of TRS 161).

The circuit arrangement shown in FIG. 6, comprising analog circuits, can be replaced almost completely (with the exception of, for example, the network diode 163, TRS161 and the resistor 162) by a circuit composed of digital modules. The speed signal is then processed to form a binary signal, via an analog-to-digital converter, which binary signal is applied, for example, to a count up/down device in order to derive a binary position signal from the binary speed signal. The two binary signals (position and speed) together form an address of a read only memory (ROM) in which the amplitudes of the actuation current are stored in digital form for the various speeds and positions. The signal appearing on the output of the read only memory is applied to a digital-to-analog converter, an output of which again controls the controllable actuation source via TRS161. If necessary, a digital hold circuit (latch flip-flops) can be inserted between the read only memory and the digital-to-analog converter, said circuit being activated by the output of the MMV141. The binary speed signal is also applied to a digital comparator which resets the MMV141.

FIG. 7 shows a simplified speed, position and actuation diagram of a recording pin which is controlled by a circuit as shown in FIG. 6. At the instant t=0, the drive section 145 is actuated, with the result that a current I starts to flow which has a maximum amplitude $I_{nom}$. The speed $\mathring{x}$ as well as the position x increase with the time. At the instant $t_1$, the nominal speed $\mathring{x}_{nom}$ is reached, and actuation is stopped. The speed $\mathring{x}$ subsequently remains substantially constant, the distance x linearly increasing until the recording pin strikes the paper. The effect of the residual acceleration described with reference to FIG. 6, occurring due to the switch-off current $U_n$, is not shown in the $\mathring{x}$ and x diagrams for the sake of clarity. The time $T_0$ expiring between the beginning of the actuation and the instant of impact is referred to as the flying time. When the pin strikes the paper, the pin rebounds. The pin then has a negative speed and the position x decreases. At the instant $t=500(\mu s)$, a second actuation takes place. The computing circuit takes into account the instantaneous position $x_1$ and speed $\mathring{x}_1$ for determining the actuation current, which in this case results in a lower amplitude current and a longer actuation period $t_2$. Even though the effect of the residual acceleration due to the switch-off currents $U_n$, $U_1$ and $U_2$ can only be roughly derived from the FIGS. 7 and 8, it will be obvious that the residual accelerations due to $U_n$, $U_1$ and $U_2$ deviate substantially from each other. The flying time $T_0$, however, has been maintained constant. After the last actuation and the second impact with the paper, the pin continues its travel in the direction of the rest position (negative speed ). The rest position is reached after $t=1500\ \mu s$, so that the recording pin then abuts against the abutment 16 for the first time and rebounds in the direction of the paper (positive speed).

FIG. 8 shows diagrams similar to those shown in FIG. 7 for other circumstances of the recording pin. After a first actuation having a duration $t_3=t_1$, which shows the same picture as FIG. 7 for $\mathring{x}$, x and I from $t=0$ to $t=500\ \mu s$, a second actuation follows at $t=1500\ \mu s$. After impact with the paper, the recording pin 77 has rebounded in the direction of the rest position; it reaches this rest position at $t=1000\ \mu s$ and then rebounds again in the direction of the paper (positive speed). At the instant of the second actuation, the pin has a (positive) speed $\mathring{x}_2$ in the direction of the paper and is situated at the position $x_2$. This results in an actuation current I having a different actuation duration $t_4$, but the same flying time $T_0$ (approximately 400 $\mu s$) as shown. Obviously, besides the described actuation pattern, other kinds of actuation patterns can occur. For example, a first actuation pulse may be followed by an arbitrary number of subsequent pulses, and an interval of arbitrary length may occur after an actuation pulse as well as after a subsequent pulse.

FIG. 9 is a perspective view of a further printer in accordance with the invention comprising a multiple impact device 200. The printer, which is illustrated in FIG. 9 merely by way of the impact device used, is of the kind described in U.S. Pat. No. 3,418,427. The electro-mechanical converters in the impact device 200 are formed by flexible, so-called bimorph crystals 201 of piezo-electric material which are shaped as strips. The crystals 201 are combined to form a block in which they are stacked with alternating supporting plates 203 and in which they are separated by insulating intermediate plates 205. A recording pin 211*a* (impact member) is secured to each crystal (for example, 201*a*) and an associated support plate (203*a*) by means of clamps 207 and 209.

Each crystal is provided on one side with a drive electrode 213 and a measuring electrode 215, and with associated counter electrodes on the other side. The drive electrode 213 and the measuring electrode 215 are separated by an electrically insulating region 214. Contact lugs 216*a, b, c* are connected to the drive electrodes, measuring electrodes and counter electrodes, respectively. The entire block formed by crystals 201, support plates 203, intermediate plates 205 and contact lugs 216 is clamped together by means of a screw/nut connection 218. The drive electrode 213 forces the crystal to assume a curved shape, in conjunction with the counter electrode, so that the recording pin 211 strikes against a, for example, pressure-sensitive paper 217, thus forming a character.

The measuring electrode 215 measures, together with the associated counter electrode, the degree of bending of the crystal 201 and thus supplies a signal which is a measure of the position of the pin 211. Instead of the integrator 153 of FIGS. 5 and 6, a differentiator is now required, the output thereof being connected to an input of the computing circuit 155 as well as the comparator 149. Furthermore, the output signal of the measuring electrode 215 (the position signal) is directly applied to the computing circuit 155 which thereby determines the amplitude of the actuation current on the basis of the position signal and also the speed signal obtained via the differentiator.

As has been illustrated on the basis of various printers in accordance with the invention in the FIGS. 1, 3 and 9, the transducer may be a speed transducer as well as a position transducer. The transducer of the printer shown in FIG. 9 is fully integrated in the impact member which is essentially formed by the crystals 201 and the recording pins 211, whereas the transducer of the printer shown in FIG. 3 is of the inductive type which is only partly integrated in the impact member (permanent magnet 133 of FIG. 4). However, the transducer may also comprise a coil which is displaceable in a permanent magnetic field and whereto an impact member is connected. If the impact member is arranged so that a part thereof (for example, one end) is displaceable between two capacitor plates, a capacitive transducer is obtained which can be used in a printer in accordance with the invention. Said part of the impact member may be provided, for example, with a dielectric layer.

What is claimed is:

1. A printer comprising an impact device including an impact member displaceable from a rest position in the direction of a record carrier by means of an electromechanical drive, the impact device further comprising a transducer which, during a displacement performed by the impact member, supplies a signal indicative of the speed of the impact member, means connecting a signal output of said transducer to a first signal input of a comparator which includes a second signal input and a signal output terminal for deriving a stop signal, means connecting a reference signal device to said second signal input of the comparator, means connecting said comparator signal output terminal to a signal input terminal of an electrical actuation device coupled to said electromechanical drive of the impact member, means responsive to a start signal for actuating said electromechanical drive via said actuation device, the actuation of the electromechanical drive being terminated only after the appearance of the stop signal at the signal output terminal of the comparator, and calculating means coupled to the transducer output for deriving a control signal determined by the speed and position of the impact member, and means coupling an output terminal of the calculating means to a control input of the actuation device so that said control signal controls the amplitude of an actuation current supplied to the electromechanical drive of the impact device.

2. A printer as claimed in claim 1, wherein the actuation device comprises a pulse generator having said signal input terminal, the pulse generator supplying pulses having a duration which is smaller than and a reptition time which is larger than the time required by the impact member to perform its maximum displacement from the rest position in the direction of the record carrier due to such pulse, the actuation of the electromechanical drive being terminated by interrupting the pulses generated by the pulse generator upon receipt of a stop signal from the signal output terminal of the comparator.

3. A printer as claimed in claim 2 wherein the pulse generator supplies identical square-wave pulses to a first signal input of an amplifier which forms a part of the actuation device and which amplifier includes a second signal input forming the control input of the actuation device to which said control signal from the calculating means is applied in order to control the amplitude of the squarewave pulses originating from the pulse generator, and means coupling a signal output of the amplifier to a signal input of the electro-mechanical drive.

4. A printer as claimed in claim 3, further comprising a hold circuit connected between the calculating means and the amplifier.

5. A printer as claimed in claim 4 wherein the hold circuit includes an output fed back via an impedance to the second input of the comparator.

6. A printer as claimed in claim 1, characterized in that the reference signal device comprises a memory in which a predetermined speed value desired for the impact member is stored.

7. A printer as claimed in claim 1 wherein at least a part of the transducer is arranged on the impact member, said part of the transducer comprising a permanent magnet which is displaceable with respect to a measuring coil having a signal output connected to the first signal input of the comparator.

8. A printer as claimed in claim 7, wherein the impact member comprises a shaft-like plunger which is linearly displaceable and one end of which co-operates with a flexible part of a rotatable type-wheel, the other end of the plunger co-operating with a pivotable arm which constitutes the armature of an electro-magnet which serves as a drive element.

9. A printer as claimed in claim 7, wherein the impact member comprises a recording pin secured to an armature made of magnetically conductive material which is displaceable by means of an excitation coil which serves as a drive element of the impact member.

10. A printer as claimed in claim 9, wherein the measuring coil and the excitation coil are cylindrical coils which are coaxially arranged with some clearance with respect to each other, the cylinder axes thereof being situated in the extension of the centre line of the recording pin, the permanent magnet being situated partly inside the measuring coil and the armature being situated partly inside the excitation coil.

11. A printer as claimed in claim 10 further comprising a cylindrical compensation coil electrically connected in series with the measuring coil and inserted between the measuring coil and the excitation coil, said compensation coil being arranged to be coaxial with two other coils with its winding direction opposing the winding direction of the measuring coil, the permanent magnet having a first magnetic pole always present within the measuring coil and a second magnetic pole, opposing the first magnetic pole, always present within the compensation coil.

12. A printer as claimed in claim 11 wherein the number of turns of the compensation coil is smaller than the number of turns of the measuring coil.

13. A printer as claimed in claim 7 wherein the impact member comprises a bending spring made of a piezoelectric material on which transducer electrodes which serve as a transducer are accommodated, one signal output thereof being connected to the first signal input of the comparator, a recording pin which extends transversely of the plane of the bending spring being secured thereto, the bending spring being provided with electrically actuated drive electrodes.

14. A printer as claimed in claim 1 wherein the amplitude of the actuation current is linearly dependent on both the position and the speed of the impact member.

15. A printer as claimed in claim 1 wherein the actuation device comprises a pulse generator and a controllable actuation source having a signal input connected to a signal output of the pulse generator, the signal input terminal and the control input of the actuation device being a first input of the pulse generator and a control input of the controllable actuation source, respectively.

16. A printer as claimed in claim 1 wherein the transducer comprises a speed transducer and the calculating means comprises at least an integrator and a computing circuit, the signal output of the transducer being directly connected to a first signal input of the computing circuit and, via the integrator, to a second signal input thereof thereby to determine the amplitude of the actuation current.

17. A printer as claimed in claim 1 wherein the transducer comprises a position transducer and the calculating means comprises at least a differentiator and a computing circuit, the signal output of the position transducer being directly connected to a first signal input of the computing circuit and, via the differentiator, to a second signal input of the computing circuit thereby to determine the amplitude of the actuation current.

18. A printer as claimed in claim 16 wherein the calculating means further comprises a hold circuit connected between the computing circuit and the control input of the actuation device.

19. A printer as claimed in claim 18 wherein the hold circuit includes an output fed back via an impedance to the second input of the comparator.

20. A printer as claimed in claim 18 wherein the actuation device includes a pulse generator and the computing circuit and the hold circuit comprise at least one operational amplifier forming an adding circuit in conjunction with three resistors connected to a non-inverting input of the amplifier, means connecting a series connection of a diode and a capacitor to an output of the operational amplifier, the amplifier output being fed back, via said diode, to an inverting input of the amplifier and with the anode of the diode connected to the output of the operational amplifier, means connecting an electrode of the capacitor to ground, means for supplying a hold signal to a junction between the diode and the capacitor via a logic gate circuit having an open collector output, and means coupling an input of said gate circuit to a signal output of the pulse generator.

* * * * *